US007264369B1

(12) United States Patent
Howe

(10) Patent No.: US 7,264,369 B1
(45) Date of Patent: Sep. 4, 2007

(54) SWITCH CONFIGURATION FOR A TACTICAL ILLUMINATOR

(75) Inventor: Alan T. Howe, Merrimack, NH (US)

(73) Assignee: Insight Technology, Inc., Londonderry, NH (US)

( * ) Notice: Subject to any disclaimer, the term of this patent is extended or adjusted under 35 U.S.C. 154(b) by 154 days.

(21) Appl. No.: 11/205,708

(22) Filed: Aug. 17, 2005

Related U.S. Application Data

(60) Provisional application No. 60/602,254, filed on Aug. 17, 2004.

(51) Int. Cl.
*F21V 33/00* (2006.01)

(52) U.S. Cl. ..... 362/114; 362/110; 362/205; 200/50.32; 42/146

(58) Field of Classification Search ..... 362/110, 362/114, 205–206; 200/18, 1 B, 50.32–50.37; 42/132, 146

See application file for complete search history.

(56) References Cited

U.S. PATENT DOCUMENTS

| | | | | |
|---|---|---|---|---|
| 4,581,686 | A | 4/1986 | Nelson | |
| 4,905,129 | A | 2/1990 | Sharrah | |
| 5,179,235 | A | 1/1993 | Toole | |
| 5,425,299 | A | 6/1995 | Teetzel | |
| 5,435,091 | A | 7/1995 | Toole et al. | |
| 5,448,847 | A | 9/1995 | Teetzel | |
| 5,522,167 | A | 6/1996 | Teetzel | |
| 5,555,662 | A | 9/1996 | Teetzel | |
| 5,584,137 | A | 12/1996 | Teetzel | |
| 5,601,359 | A | 2/1997 | Sharrah et al. | |
| 5,628,555 | A | 5/1997 | Sharrah et al. | |
| 5,654,594 | A | 8/1997 | Bjornsen, III et al. | |
| 5,685,105 | A | 11/1997 | Teetzel | |
| 5,706,600 | A | 1/1998 | Toole et al. | |
| 5,787,628 | A | 8/1998 | Teetzel | |
| 5,822,905 | A | 10/1998 | Teetzel | |
| 6,276,088 | B1 | 8/2001 | Matthews et al. | |
| 6,283,611 | B1 | 9/2001 | Sharrah et al. | |
| 6,345,464 | B1 | 2/2002 | Kim et al. | |
| 6,386,730 | B1 | 5/2002 | Matthews | |
| 6,526,688 | B1 | 3/2003 | Danielson et al. | |
| 6,578,311 | B2 | 6/2003 | Danielson et al. | |
| 6,609,810 | B2 | 8/2003 | Kim | |
| 6,622,416 | B2 | 9/2003 | Kim | |
| 6,675,521 | B1 | 1/2004 | Kim | |
| 6,841,941 | B2 | 1/2005 | Kim et al. | |
| 2002/0100204 | A1 * | 8/2002 | Kim | 42/146 |
| 2003/0133286 | A1 * | 7/2003 | Kim | 362/110 |
| 2005/0217162 | A1 | 10/2005 | Matthews et al. | |
| 2005/0243542 | A1 | 11/2005 | Kim | |
| 2005/0246937 | A1 | 11/2005 | Kim | |

OTHER PUBLICATIONS

Insight Technology, Inc., M3 Tactical Illuminator, Operator's Manual, GLL-Manual Rev. 0; Believed by Applicant to be representative of prior art.

Insight Technology, Inc., M6 Tactical Laser Illuminator, Operator's Manual, Rev. 0903; Believed by Applicant to be representative of prior art.

UITC Armament Corp., Discover Your True Tactical Advantage with Night Stalker Laser Sights & Accessories, Copyright 1996.

* cited by examiner

*Primary Examiner*—Laura Tso

(57) ABSTRACT

A tactical illuminator has a first switch for providing a lesser amount of visible light on an area of interest than a second switch. The first switch being in close proximity to the second switch to allow an operator to quickly and easily move his finger or thumb from the first switch to the second switch when a need for greater light is encountered. A tactical illuminator has a rotatable switch moveable from a first position that provides a lower level of light output to a second position that provides a greater level of light output. The operator actuating the switch by sliding his finger or thumb parallel to a longitudinal axis of a weapon barrel.

22 Claims, 7 Drawing Sheets

120
108
30
F1
F3
F2
110
112
102
104
106
100
200
202
LA

120
$F_4$
140
A
$\theta_1$
B
$\theta_2$
C
102
104
112
106
300
200
202
LA

SWITCH CONFIGURATION FOR A TACTICAL ILLUMINATOR

CROSS REFERENCE TO RELATED APPLICATIONS

The present application claims the benefit of U.S. provisional patent applications Ser. No. 60/602,254, filed Aug. 17, 2004, the entire disclosure of which is incorporated herein by reference.

TECHNICAL FIELD

The present invention is generally related to tactical illuminators and, more particularly, to a switch assembly and method for illuminating an area of interest at two or more illumination levels.

BACKGROUND OF THE INVENTION

The need to be able to effectively see a target and aim a weapon in the direction of the target is well recognized. Tactical illuminators to facilitate illuminating a target and aiming a weapon, especially under low light conditions, are known. Tactical illuminators have an incandescent lamp or light emitting diode (LED) to provide general illumination of an area or person of interest. The output is typically a white light capable of projecting 40 to 150 lumens, although higher output lights are also known. The tactical illuminator may be attached to a weapon, for example a handgun, long gun, or shotgun, in a variety of different ways.

Known tactical illuminators have a "creep" light that allows a law enforcement officer to approach a hide out with enough light to navigate and a separate bright light for illuminating the area or person of interest.

The tactical illuminators typically have one or more switches to turn the light on or off. The switches have been located on the sides and ends of the devices. Some tactical illuminators combine one or more different type switches to accomplish the switching function.

SUMMARY OF THE INVENTION

According to one aspect of the invention, there is provided a tactical illuminator for use on a weapon having a barrel having a longitudinal axis. The illuminator has a housing for enclosing at least a portion of a power source, at least one source of illumination at least partially disposed in the housing, a first switch disposed on the housing and configured to couple the power source to the at least one source of illumination when actuated to project a first amount of visible light, and a second switch disposed on the housing in juxtaposition to the first switch and configured to couple the power source to the at least one source of illumination when actuated to project a second amount of visible light. The first switch configured to be actuated by a compressive force generally perpendicular to the longitudinal axis of the weapon and the second switch configured to be actuated by a compressive force at an angle other than generally perpendicular to the longitudinal axis of the weapon.

According to a further aspect of the invention, there is provided a tactical illuminator for use on a weapon having a barrel having a longitudinal axis. The illuminator has a housing for enclosing at least a portion of a power source, a first source of illumination at least partially disposed in the housing, a second source of illumination at least partially disposed in the housing, a first switch disposed on the housing and configured to couple the power source to the first source of illumination, and a second switch disposed on the housing in juxtaposition to the first switch and configured to couple the power source to the second source of illumination. The first switch configured to be actuated by a compressive force generally perpendicular to the longitudinal axis of the weapon and the second switch configured to be actuated by a compressive force at an angle other than generally perpendicular to the longitudinal axis of the weapon.

According to a yet a further aspect of the invention, there is provided a tactical illuminator for use on a weapon having a barrel having a longitudinal axis. The tactical illuminator has a housing for enclosing at least a portion of a power source, a least one source of illumination at least partially disposed in the housing, and a switch disposed on the housing and rotatable about an axis of rotation generally perpendicular to the longitudinal axis of the barrel. The switch rotatable between a first position in which a first amount of visible light projects and a second position in which a second amount of visible light projects.

These and other objects, advantages and features of the embodiments will become readily apparent from the following description taken with reference to the accompanying drawings.

DETAILED DESCRIPTION OF THE INVENTION

Figure 1:
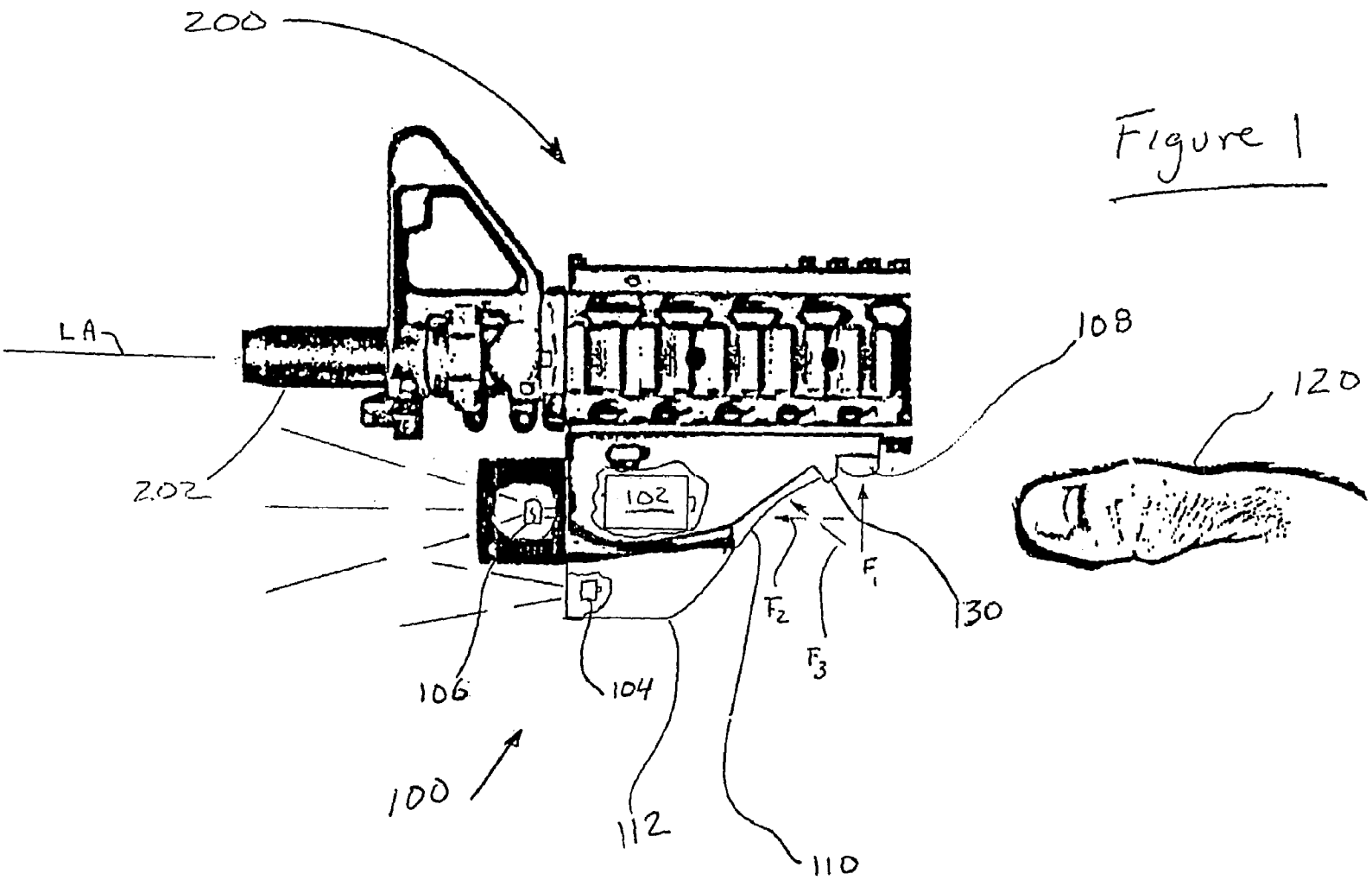
FIG. 1 is a side view of a tactical illuminator consistent with the invention.
Figure 2:
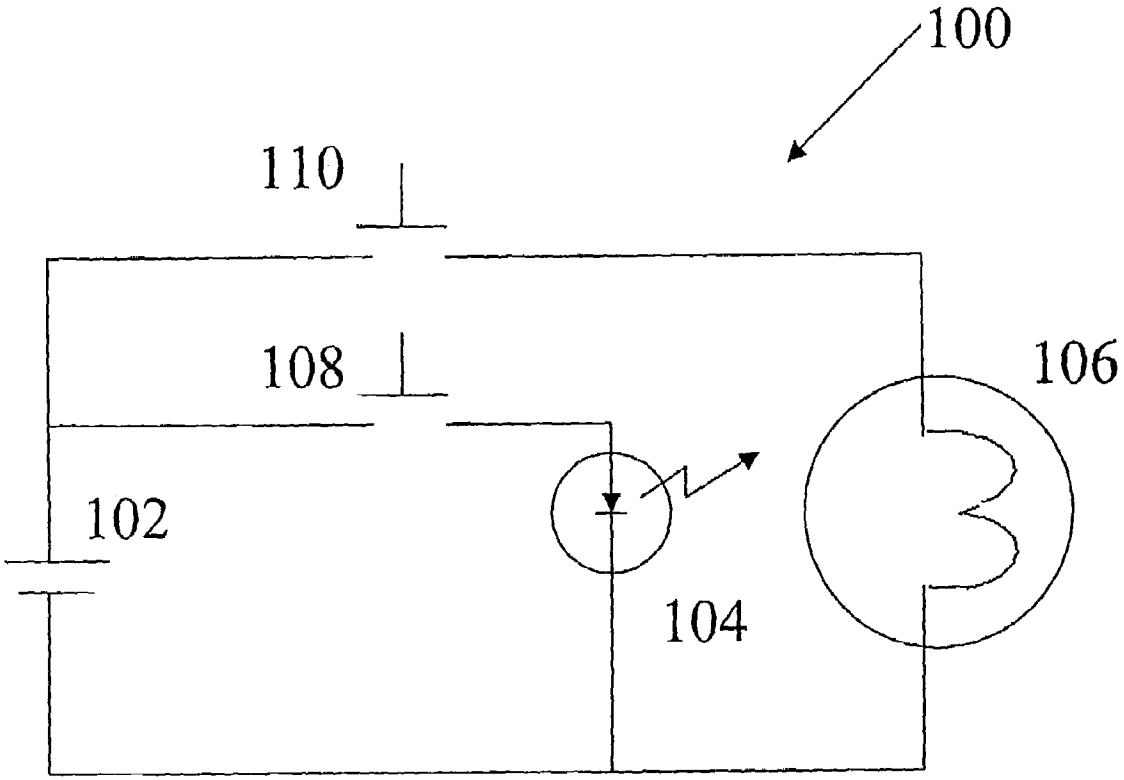
FIG. 2 is an electrical schematic for the tactical illuminator of FIG. 1.

FIG. 1 is a side view and FIG. 2 is an electrical schematic of a tactical illuminator 100 consistent with the invention. The tactical illuminator 100 may have a power source 102, for example a dry cell battery, a first source of illumination 104, for example an incandescent lamp, an LED, or other visible light source, a second source of illumination 106, for example an incandescent lamp, an LED, or other visible light source, a first switch 108, and a second switch 110 at least partially disposed in a housing 112. The switches 108, 110 may employ a silicone overlay over tactile dome switches. The overlay may be coupled to the housing 112 to seal out moisture and particulates. Although the switches 108, 110 have been shown as being dome switches, other switches, including, but not limited to, touch sensitive, proximity sensitive, rocker and linear switches, may be used without departing from the invention. Although the switches 108, 110 are shown as momentary switches, they may be maintained or a combination of maintained and momentary without departing from the invention. The switches 108, 110 may include protrusions or indentations for tactile feedback to the operator. Alternatively, the switches may be coupled to a microcontroller that in turn controls the sources of illumination.

The first switch 108 may be in series with the first source of illumination 104 and the second switch 110 may be in series with the second source of illumination 106. The first source of illumination 104 may be used to provide sufficient light to navigate (5-75 lumens) under darkened conditions and the second source of illumination 106 may be used as a bright light (40-250 lumens) for illuminating the area or person of interest. The first source of illumination 104 may be a white or non white light, for example a red, blue, or green light and the second source of illumination 106 may be a white light. The range of lumen output for the first source and second source of illumination are provided for illustrative purpose and are not intended to be limiting.

As shown in FIG. 1, the tactical illuminator 100 may be coupled to a weapon 200 having a barrel 202 with a longitudinal axis LA. The tactical illuminator 100 may be mounted to the side of (as shown), on top of, or below the barrel 202 without departing from the invention. The light emanating from the tactical illuminator 100 may be directed generally parallel to the barrel 202. The tactical illuminator 100 may be coupled to the weapon 200 in any known manner, for example with a side clamping mechanism. U.S. Pat. No. 6,574,901, entitled Auxiliary Device for a Weapon and Attachment Thereof, discloses a method of securing an auxiliary device to a weapon and is incorporated herein by reference in its entirety. The first switch 108 and the second switch 110 may be juxtaposed along a surface of the tactical illuminator. The second switch 110 may be twice as large in surface area as the first switch 108 and may be oriented at an angle to the longitudinal axis LA. The first switch 108 may be separated from the second switch 110 by a divider 130. The first switch 108 may be actuated by a force F, aligned generally perpendicular to the longitudinal axis LA of the weapon 200 and the second switch 110 may be actuated by a force $F_2$ aligned generally parallel to the longitudinal axis LA or a force $F_3$ aligned at an angle to the longitudinal axis LA.

Because of the difference in size and location, the separate switches 108, 110 may accommodate, not only two separate elements, but also two separate operational modes, (fine motor skills and gross motor skills). During periods of low stress, fine motor skills are available to manipulate the smaller switch 108 to activate the lower light output source of illumination 104, for example an LED. This may be used when the operator is trying to approach an area of interest while not being detected ("creep" mode). During periods of higher stress, when fine motor skills rapidly degrade, gross motor skills are still available and employed against the larger angled switch 110 to activate the higher light output source of illumination 106. This may be used when the operator enters the area of interest or encounters the person or target of interest.

The close proximity of the first switch 108 and the second switch 110 may allow an operator to approach an area of interest with his/her thumb 120 or other finger located a spaced distance from the first switch 108. The operator may press the first switch 108 with his or her thumb 120 when necessary to provide sufficient light to navigate while also having his/her thumb 120 a spaced distance from the second switch 110. The operator can simply slide his/her thumb 120 along the longitudinal axis LA of the weapon 200 when s/he has a need for a brighter light.

Figure 3:
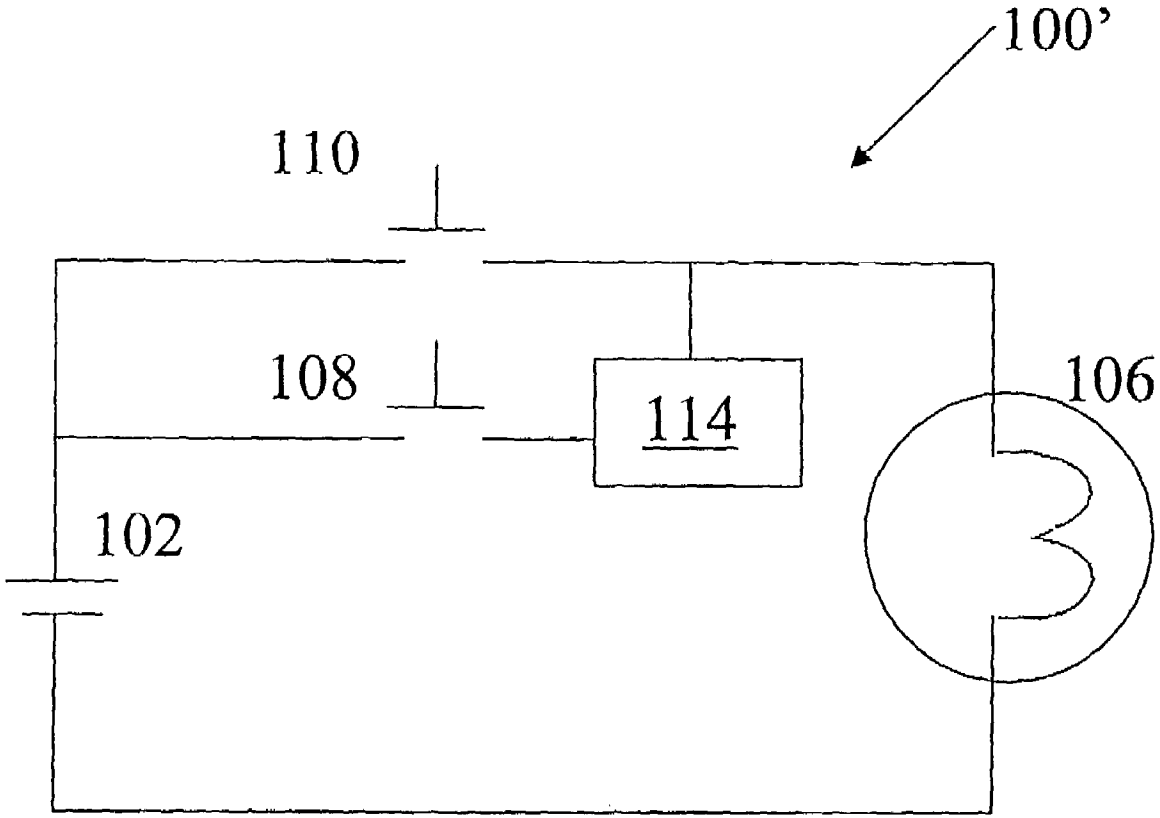
FIG. 3 is an alternative electrical schematic for the tactical illuminator of FIG. 1.

As shown in FIG. 3, the tactical illuminator 100 may have a power source 102, for example a dry cell battery, a source of illumination 106, for example an incandescent lamp, an LED, or other visible light source, a first switch 108, a second switch 110, and an electrical component 114 at least partially disposed in a housing. The first switch 108 may be in series with the electrical component 114 which may be capable of manipulating, for example increasing, or more preferably decreasing, the power to the source of illumination 106 and the second switch 110 may be in series with the source of illumination 106. The electrical component 114 may include, but is not limited to, a resistor, inductor, capacitor, diode, transformer, or controllably conductive device, for example back-to-back SCRs, a triac, a MOSFET, and an IGBT.

Figure 4:
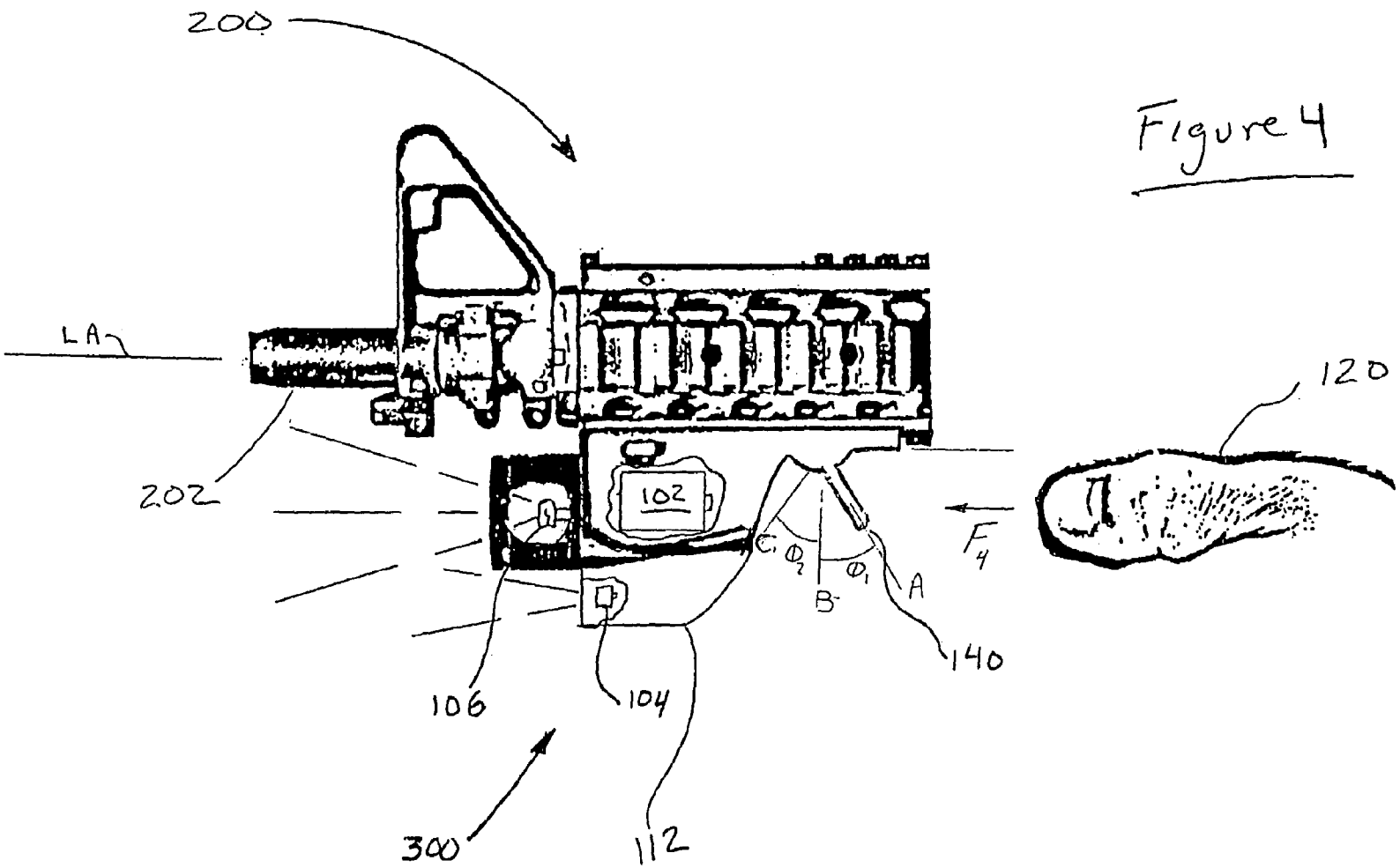
FIG. 4 is a side view of a second tactical illuminator consistent with the invention.
Figure 5:
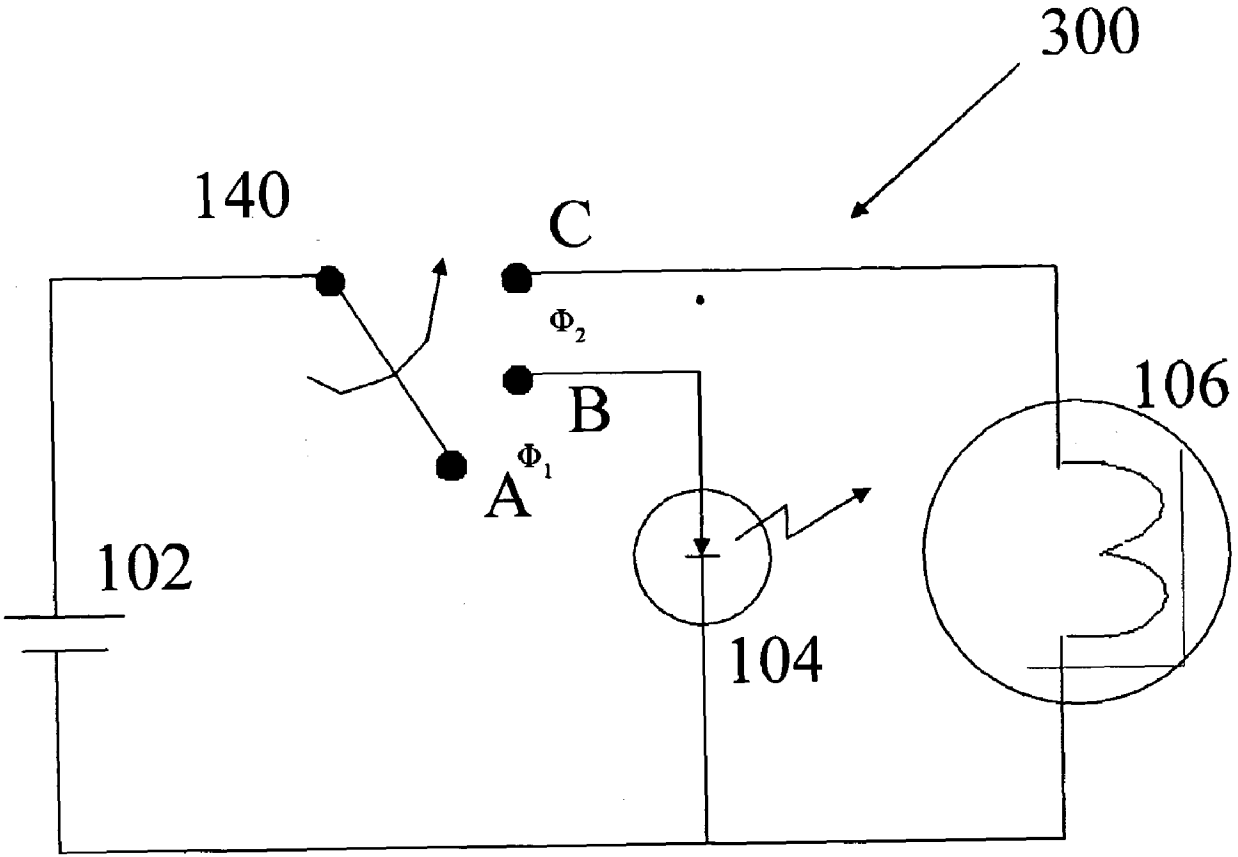
FIG. 5 is an electrical schematic for the tactical illuminator of FIG. 4.

As shown in FIGS. 4 and 5, the first switch 108 and the second switch 110 may be incorporated into a rocker switch 140 with its axis of rotation aligned perpendicular to the longitudinal axis LA of the weapon 200 such that a force $F_4$ applied generally parallel to the longitudinal axis LA of the weapon 200 turns on the first source of illumination 104 and the second source of illumination 106. Rotation of the rocker switch 140 through a first angle $\Phi_1$ may couple the power source 102 to the first source of illumination 104 and further rotation of the rocker switch 140 through a second angle $\Phi_2$ may couple the power source 102 to the second source of illumination 106.

Figure 6:
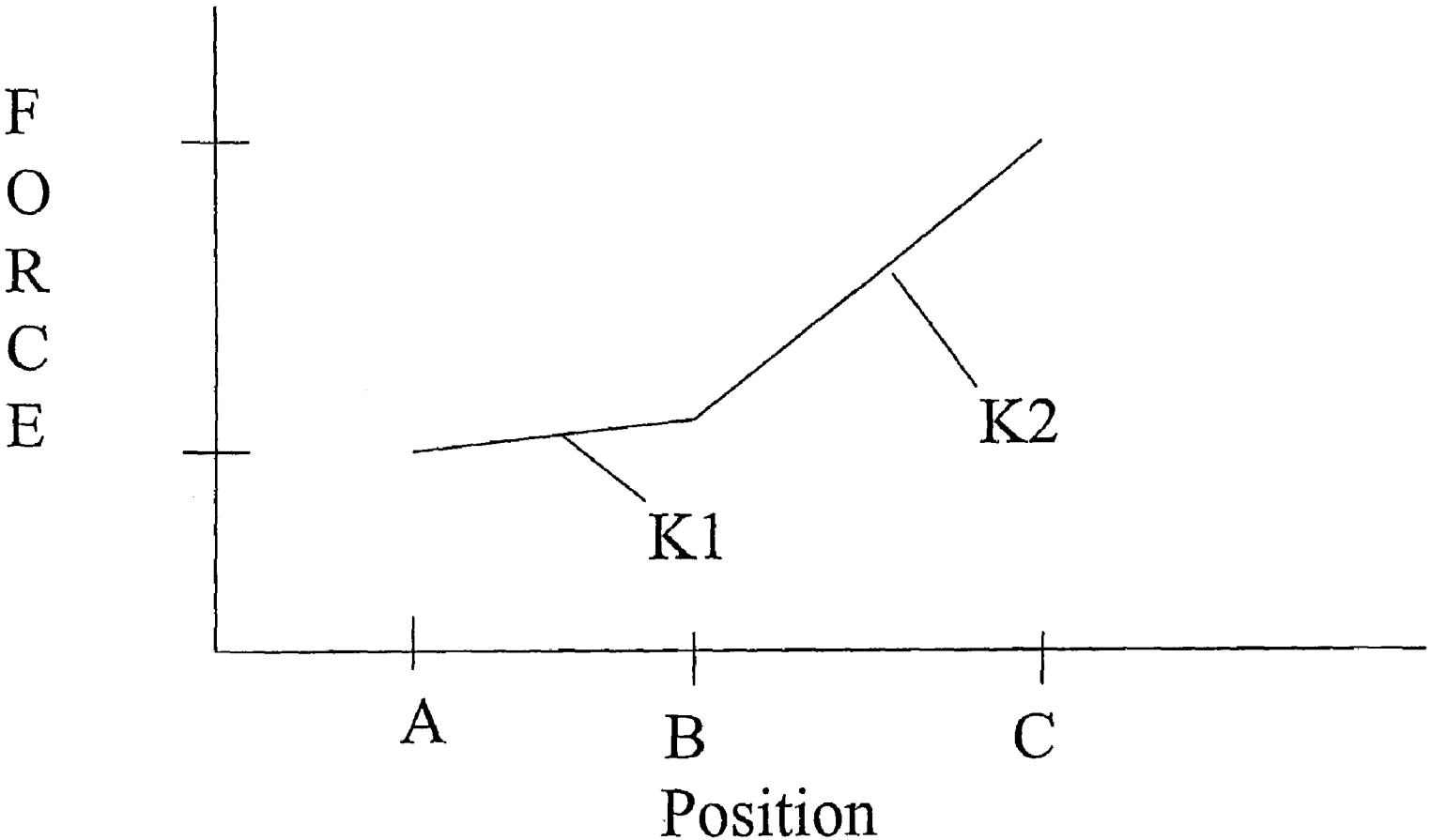
FIG. 6 is a plot consistent with the invention of force versus angular position of a switch for use in the tactical illuminator of FIG. 4.

As shown in FIGS. 5 and 6, the rocker switch 140 may have a first spring constant $K_1$ from position A (off) to a second position B (low light) and a second spring constant $K_2$ from position B to position C (bright light).

Figure 7:
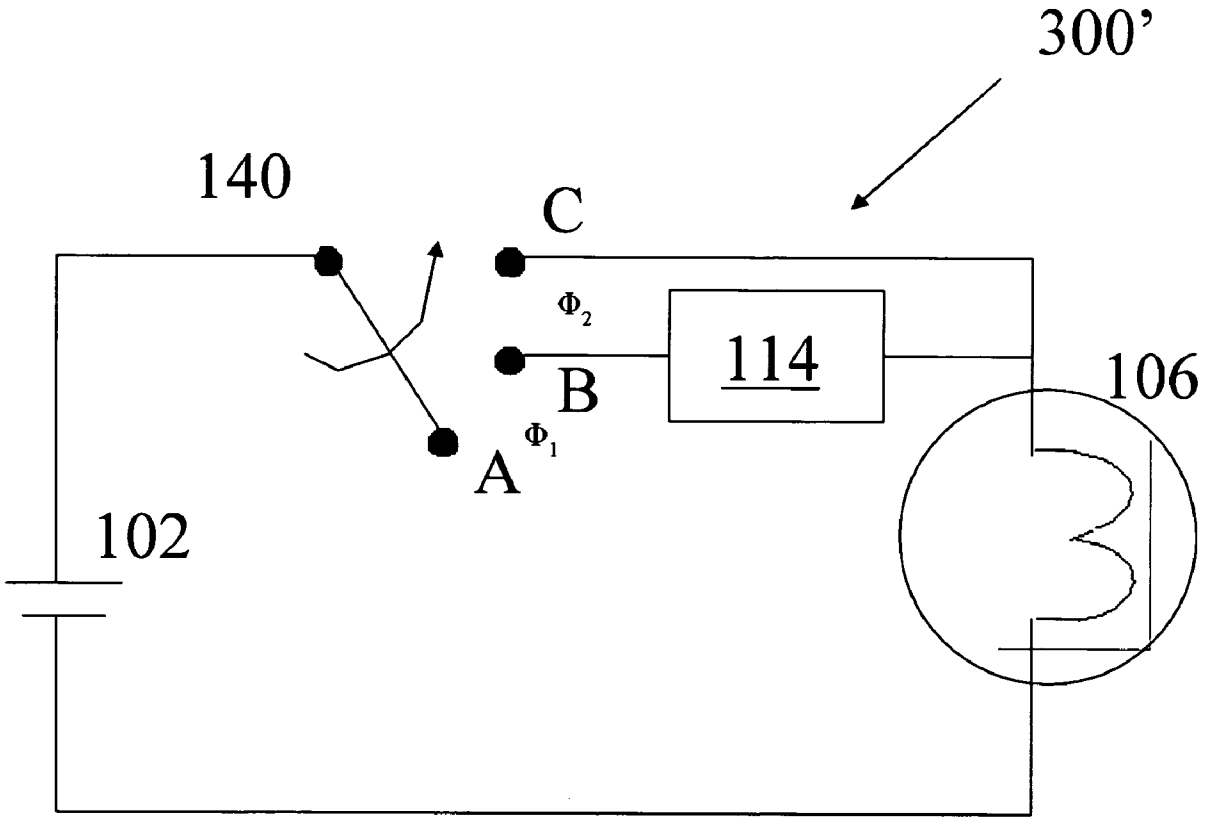
FIG. 7 is an alternative electrical schematic for the tactical illuminator of FIG. 4.

Alternatively, as shown in FIG. 7, rotation of the rocker switch 140 through the first angle $\Phi_1$ may couple the power source 102 to the source of illumination 106 through the electrical component 114 and further rotation of the rocker switch 140 may couple the power source 102 to the source of illumination 106.

Although several embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to be limited thereby.

I claim:

1. A tactical illuminator for use on a weapon having a barrel having a longitudinal axis, comprising:

a housing for enclosing at least a portion of a power source;

at least one source of illumination at least partially disposed in the housing;

a first switch disposed on the housing and configured to couple the power source to the at least one source of illumination when actuated to project a first amount of light, the first switch configured to be actuated by a compressive force generally perpendicular to the longitudinal axis of the weapon; and a second switch disposed on the housing in juxtaposition to the first switch and configured to couple the power source to the at least one source of illumination when actuated to project a second amount of light, the second switch configured to be actuated by a compressive force at an angle other than generally perpendicular to the longitudinal axis of the weapon.

2. The tactical illuminator of claim 1, wherein the second switch is configured to be actuated by a compressive force generally parallel to the longitudinal axis of the weapon.

3. The tactical illuminator of claim 1, wherein the second amount of light is visible light and is greater than the first amount of light.

4. The tactical illuminator of claim 1, further comprising an electrical component in series with the first switch, the electrical component capable of manipulating power to the first source of illumination.

5. The tactical illuminator of claim 4, wherein the electrical component is a resistor.

6. The tactical illuminator of claim 1, wherein actuation of the first switch a plurality of times within a predetermined period of time causes the at least one source of illumination to latch on.

7. A tactical illuminator for use on a weapon having a barrel having a longitudinal axis, comprising:

a housing for enclosing at least a portion of a power source;

a first source of illumination at least partially disposed in the housing;

a second source of illumination at least partially disposed in the housing;

a first switch disposed on the housing and configured to couple the power source to the first source of illumination when actuated, the first switch configured to be actuated by a compressive force generally perpendicular to the longitudinal axis of the weapon; and a second switch disposed on the housing in juxtaposition to the first switch and configured to couple the power source to the second source of illumination when actuated, the second switch configured to be actuated by a compressive force at an angle other than generally perpendicular to the longitudinal axis of the weapon.

8. The tactical illuminator of claim 7, wherein the second switch is configured to be actuated by a compressive force generally parallel to the longitudinal axis of the weapon.

9. The tactical illuminator of claim 7, wherein the first source of illumination projects a visible white light and the second source of illumination projects a visible non-white light.

10. The tactical illuminator of claim 7, wherein the first switch when actuated projects a first amount of visible light and the second switch when actuated projects a second amount of visible light.

11. The tactical illuminator of claim 10, wherein the second amount of visible light is greater than the first amount of visible light.

12. The tactical illuminator of claim 7, wherein the first switch and the second switch employ a silicone overlay over a tactile dome switch.

13. The tactical illuminator of claim 7, wherein the first switch has a protrusion for providing tactile feedback to an operator.

14. A tactical illuminator for use on a weapon having a barrel having a longitudinal axis, comprising:

a housing for enclosing at least a portion of a power source;

a least one source of illumination at least partially disposed in the housing; and a rocker switch disposed on the housing and rotatable about an axis of rotation generally perpendicular to the longitudinal axis of the barrel, the switch rotatable between a first position and a second position, in the first position a first amount of light projects and in the second position a second amount of light projects, wherein a user actuates the rocker switch through a first arc to get to the first potion and continues through a second arc to get to the second position.

15. The tactical illuminator of claim 14, wherein a required force to rotate the rocker switch from an off position to the first position is less than a required force to rotate the switch from the first position to the second position.

16. The tactical illuminator of claim 14, wherein the second amount of light is visible light and is greater than the first amount of light.

17. The tactical illuminator of claim 14, further comprising an electrical component in series with the rocker switch when the rocker switch is in the first position, the electrical component capable of manipulating power to the at least one source of illumination.

18. The tactical illuminator of claim 17, wherein the electrical component is a resistor.

19. The tactical illuminator of claim 14, further comprising a second source of illumination, the rocker switch is in series with the first source of illumination when the switch is in the first position and the switch is in series with the second source of illumination when the switch is in the second position.

20. The tactical illuminator of claim 14, wherein the at least one source of illumination is a selected one of an incandescent lamp and a light emitting diode.

21. The tactical illuminator of claim 1, wherein a user can actuate the first switch with their thumb and then slide their thumb along the longitudinal axis to actuate the second switch.

22. The tactical illuminator of claim 7, wherein a user can actuate the first switch with their thumb and then slide their thumb along the longitudinal axis to actuate the second switch.

* * * * *